US005415576A

United States Patent [19]

Meisenburg et al.

[11] Patent Number: 5,415,576

[45] Date of Patent: * May 16, 1995

[54] COUNTER-ROTATING SURFACING MARINE DRIVE WITH DEFINED X-DIMENSION

[75] Inventors: Gary L. Meisenburg, Stillwater, Okla.; Charles F. Alexander, Jr., Austin, Tex.; Daniel F. McCormick, Oshkosh, Wis.; Phillip D. Magee; Edward C. Eick, both of Stillwater, Okla.

[73] Assignee: Brunswick Corporation, Lake Forest, Ill.

[ * ] Notice: The portion of the term of this patent subsequent to Jul. 7, 2010 has been disclaimed.

[21] Appl. No.: 83,701

[22] Filed: Jun. 25, 1993

Related U.S. Application Data

[63] Continuation-in-part of Ser. No. 889,495, May 27, 1992, Pat. No. 5,230,644, and Ser. No. 889,530, May 27, 1992, Pat. No. 5,249,995.

[51] Int. Cl.[6] ..... B63H 5/10

[52] U.S. Cl. ..... 440/80

[58] Field of Search ..... 440/76–83, 440/88, 900, 75, 66, 53

[56] References Cited

U.S. PATENT DOCUMENTS

| | | | |
|---|---|---|---|
| 3,164,121 | 1/1965 | Alexander | 440/88 |
| 3,952,686 | 4/1976 | Pichl | 115/7 |
| 4,630,719 | 12/1986 | McCormick | 192/21 |
| 4,679,682 | 7/1987 | Gray, Jr. et al. | 192/21 |
| 4,764,135 | 8/1988 | McCormick | 440/83 |
| 4,775,342 | 10/1988 | Conner et al. | 440/61 |
| 4,790,782 | 12/1988 | McCormick | 440/61 |
| 4,792,315 | 12/1988 | Karrasch et al. | 440/83 |
| 4,795,382 | 1/1989 | McCormick | 440/81 |
| 4,832,635 | 5/1989 | McCormick | 440/78 |
| 4,832,636 | 5/1989 | McCormick | 440/80 |
| 4,863,406 | 9/1989 | Bland et al. | 440/83 |
| 4,869,121 | 9/1989 | Meisenburg | 440/80 |
| 4,869,694 | 9/1989 | McCormick | 440/83 |
| 4,871,334 | 10/1989 | McCormick | 440/89 |
| 4,897,058 | 1/1990 | McCormick | 440/80 |
| 4,900,281 | 2/1990 | McCormick | 440/78 |
| 4,993,848 | 2/1991 | John et al. | 440/78 |

*Primary Examiner*—Edwin L. Swinehart

*Attorney, Agent, or Firm*—Andrus, Sceales, Starke & Sawall

[57] ABSTRACT

A marine drive (10) has two counter-rotating surface operating propellers (12 and 14). The drive has a vertical X-dimension (254) in the range of about 13 inches to 19 inches in combination with a shaft-spacing dimension (258) in the range of about 8 inches to 15 inches in combination with a surfacing dimension ≧ zero. In one embodiment, the shaft-spacing dimension is 13.5 inches, the vertical X-dimension is 16 inches, and the surfacing dimension is 2 inches.

11 Claims, 4 Drawing Sheets

COUNTER-ROTATING SURFACING MARINE DRIVE WITH DEFINED X-DIMENSION

CROSS REFERENCE TO RELATED APPLICATIONS

This application is a continuation-in-part of allowed U.S. application Ser. No. 07/889,495, filed May 27, 1992, now U.S. Pat. No. 5,230,644, and allowed U.S. application Ser. No. 07/889,530, filed May 27, 1992, now U.S. Pat. No. 5,249,995, incorporated herein by reference.

BACKGROUND AND SUMMARY

The invention relates to a marine drive having two counter-rotating surface operating propellers.

The present invention arose during development efforts directed toward a marine drive enabling increased top end boat speed. This is achieved by raising the torpedo or gear box out of the water to reduce drag, and by using two counter-rotating surface operating propellers. Surfacing drives are known in the art, for example U.S. Pat. No. 4,871,334, column 3, lines 35+.

The drive has a transom X-dimension defined as the distance along the transom of the boat between the axis of rotation of the engine-driven shaft and the bottom of the boat. The drive has a vertical X-dimension defined as the vertical distance between the axis of rotation of the engine-driven shaft and the plane of the bottom of the boat. The drive has a shaft-spacing dimension defined as the distance between the axis of rotation of the upper input shaft in the upper horizontal bore and the axis of rotation of the concentric counter-rotating. propeller shafts in the lower horizontal bore. The drive has a surfacing dimension defined as the vertical distance between the bottom of the torpedo and the plane of the bottom of the boat when the propeller shafts are parallel to such plane.

The present invention provides structure enabling a surfacing drive without increasing the X-dimension. This in turn enables the boat builder to provide a surfacing drive without otherwise having to mount the drive high on the transom and the engine high in the boat. The invention provides various desirable combinations of defined X-dimension, shaft-spacing dimension, and surfacing dimension.

DETAILED DESCRIPTION

Figure 1:
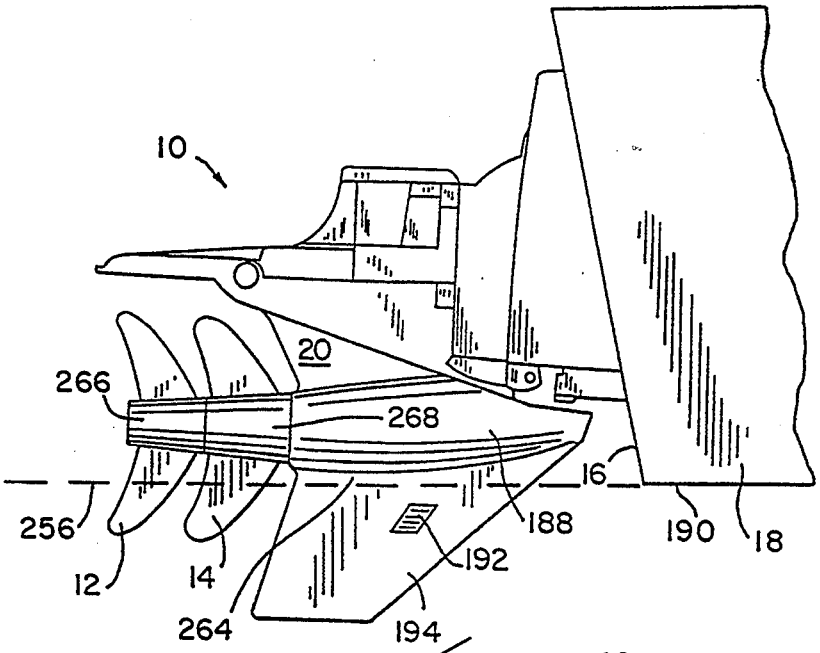
FIG. 1 is a side elevation view of a marine drive in accordance with the invention.

FIG. 1 shows a marine drive 10 having two counter-rotating surface operating propellers 12 and 14. The drive is mounted to the transom 16 of a boat 18 in the usual manner for a stern drive. The drive includes a housing 20, FIG. 2, having upper and lower spaced horizontal bores 22 and 24, and an intersecting vertical bore 26 extending therebetween. An upper input shaft 28 is in upper horizontal bore 22 and is coupled through a universal joint 30 to a shaft 32 driven by the engine (not shown) in the boat. The universal joint enables trimming and steering of the drive. The input shaft drives an upper gear assembly 34 which is known in the art, for example as shown in U.S. Pat. Nos. 4,630,719, 4,679,682, and 4,869,121, incorporated herein by reference. A downwardly extending driveshaft 36 in vertical bore 26 is driven by input shaft 28 through upper gear assembly 34 operatively connected therebetween. Input gear 38 on shaft 28 rotates about a horizontal axis and drives gears 40 and 42 to rotate in opposite directions about a vertical axis. Shift and clutch assembly 44 causes engagement of one or the other of gears 40 and 42, to in turn cause rotation of driveshaft 36 in one or the other direction, to provide forward or reverse operation, all as in the noted incorporated patents.

Figure 3:
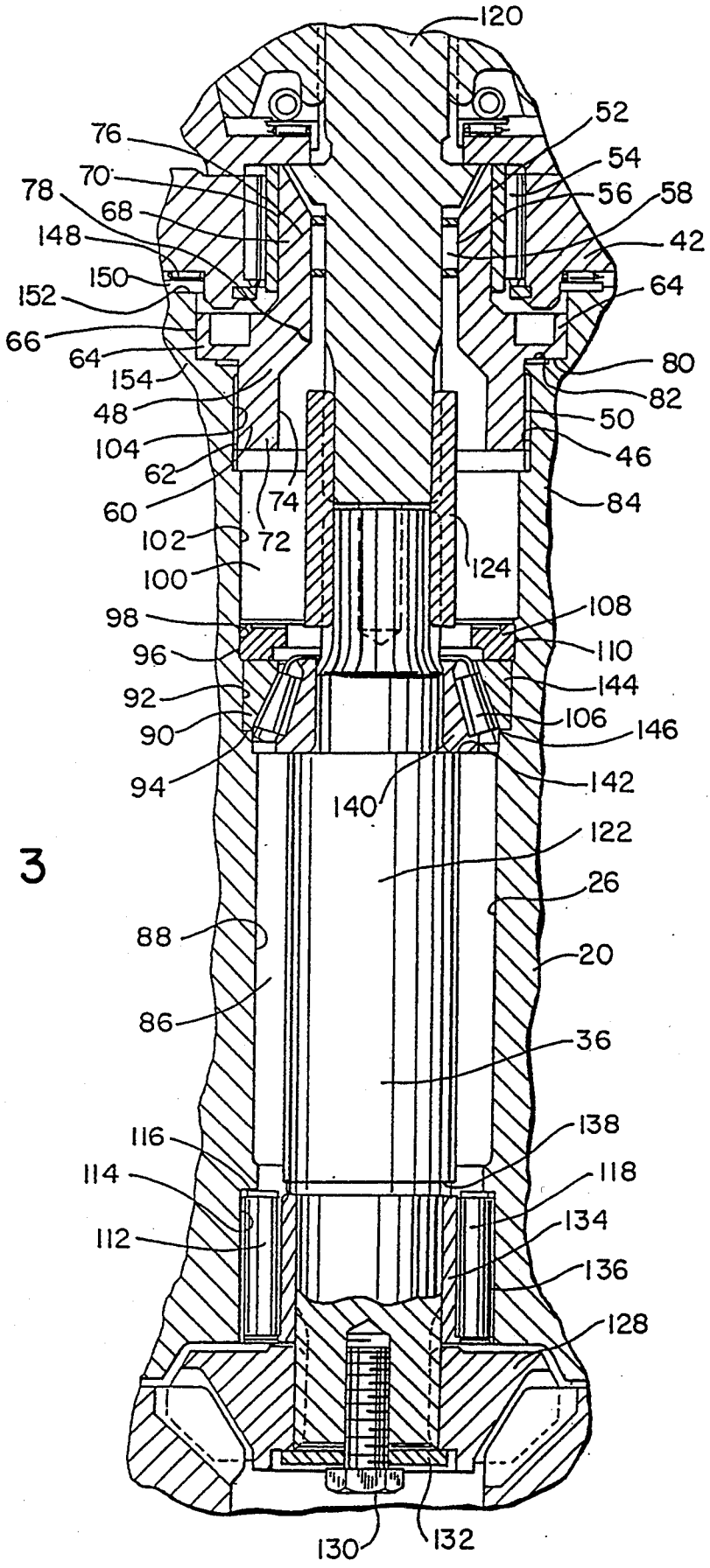
FIG. 3 is an enlarged view of a portion of the structure of FIG. 2.

Vertical bore 26 has an upper threaded portion 46, FIG. 3. An upper adaptor spool 48 has a lower threaded outer portion 50 mating with threaded portion 46 of vertical bore 26 and supporting gear 42 for rotation about driveshaft 36. Adaptor spool 48 has an upper outer surface 52 supporting an upper outer needle bearing 54 which supports gear 42 for rotation about adaptor spool 48. Adaptor spool 48 has an upper inner surface 56 supporting an upper inner needle bearing 58 which supports driveshaft 36 for rotation in adaptor spool 48.

Adaptor spool 48 has a lower outer section 60, FIG. 3, of a first outer diameter 62 and threaded as noted at 50 and mating with upper threaded portion 46 of vertical bore 26. Adaptor spool 48 has a central outer section 64 above lower outer section 60 and of a central outer diameter 66 larger than lower outer diameter 62. Adaptor spool 48 has an upper outer section 68 above central outer section 64 and of an upper outer diameter 70 less than central outer diameter 66 and less than lower outer diameter 62. Adaptor spool 48 has a lower inner section 72 of a lower inner diameter 74 within vertical bore 26. Adaptor spool 48 has an upper inner section 76 above lower inner section 72 and of an upper inner diameter 78 less than lower inner diameter 74. Upper outer needle bearing 54 is between gear 42 and upper outer section 68 of adaptor spool 48 and supports gear 42 for rotation about adaptor spool 48. Upper inner needle bearing 58 is between driveshaft 36 and upper inner section 76 of adaptor spool 48 and supports driveshaft 36 for rotation in adaptor spool 48. Lower outer section 60 and central outer section 64 of adaptor spool 48 meet at a downwardly facing annular shoulder 80 at the top end 82 of housing sidewall 84 forming vertical bore 26. Upper outer diameter 70 is substantially equal to lower inner diameter 74 of adaptor spool 48.

Figure 4:
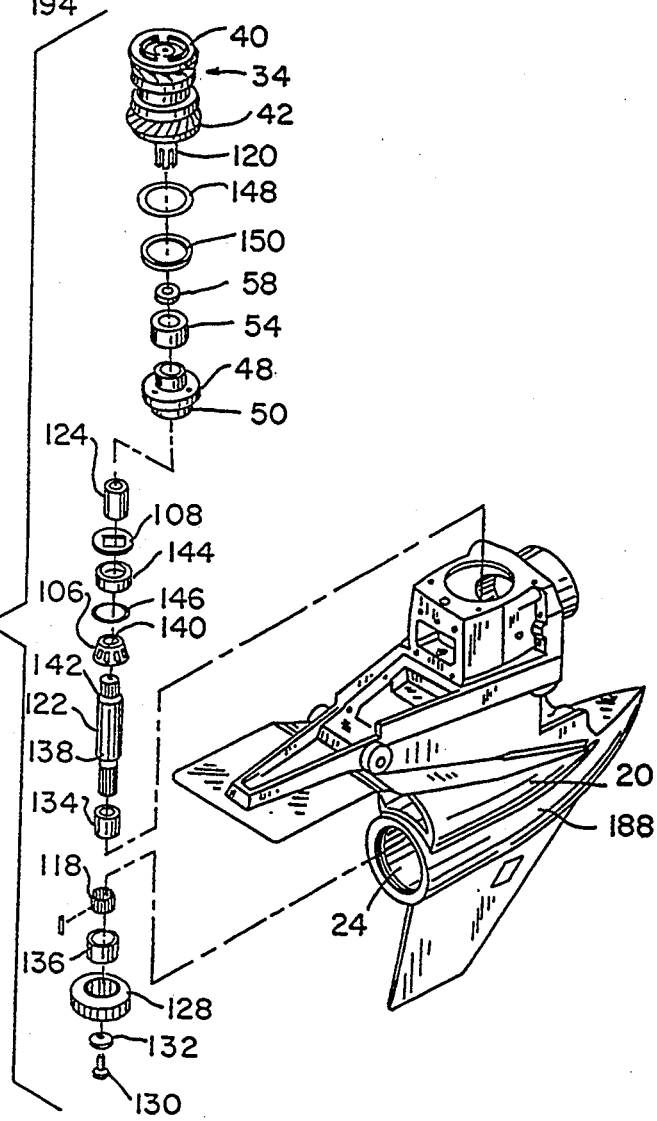
FIG. 4 is an exploded perspective view of a portion of the structure of FIG. 1.

Vertical bore 26 has a first section 86, FIG. 3, of a first inner diameter 88. Vertical bore 26 has a second section 90 above first section 86 and of a second inner diameter 92 larger than inner diameter 88. Sections 86 and 90 meet at an upwardly facing annular shoulder 94. Vertical bore 26 has a first thread 96 above second section 90 and of an inner diameter 98 at least as great as second inner diameter 92. Vertical bore 26 has a third section 100 above first thread 96 and of a third inner diameter 102 greater than second inner diameter 98. Vertical bore 26 has a second thread, provided by the noted thread 46, above third section 100 and of an inner diameter 104 at least as great as third inner diameter 102. A central tapered roller thrust bearing 106 is seated against shoulder 94 of vertical bore 26. An annular ring 108 has a threaded outer portion 110 mating with thread 96 of vertical bore 26 and retains bearing 106 against shoulder 94. Vertical bore 26 has a fourth section 112 below first section 86 and of a fourth inner diameter 114 larger than first inner diameter 88. First and fourth sections 86 and 112 meet at a downwardly facing annular shoulder 116. A lower needle bearing 118 is seated against downwardly facing shoulder 116 and supports driveshaft 36 for rotation. Central and upper bearings 106 and 58 are inserted into vertical bore 26 from above, FIG. 4. Lower bearing 118 is inserted into vertical bore 26 from below.

Driveshaft 36, FIG. 3, is a two piece member formed by an upper driveshaft segment 120 and a lower driveshaft segment 122 coupled by a sleeve 124 in splined relation. Central bearing 106 and lower bearing 118 support the lower driveshaft segment 122. Upper bearing 58 supports the upper driveshaft segment 120. The upper driveshaft segment is also supported by another upper needle bearing 126, FIG. 2, as in the noted incorporated patents.

Driveshaft 36 has a lower pinion gear 128, FIG. 3, mounted thereto by bolt 130 and washer 132. Needle bearing 118 is above pinion gear 128 and is supported between inner and outer races 134 and 136. Outer race 136 engages shoulder 116, and inner race 134 engages shoulder 138 on lower driveshaft segment 122. Bearing 106 has an inner race 140 engaging shoulder 142 on lower driveshaft segment 122. Bearing 106 has an outer race 144 stopped against shoulder 94 in bore 26. One or more shims 146 may be provided between outer race 144 and shoulder 94 to adjust axial positioning if desired. Gear 42 rotates on bearing 148 on race 150 seated on shoulder 152 of housing sidewall 154.

Figure 2:
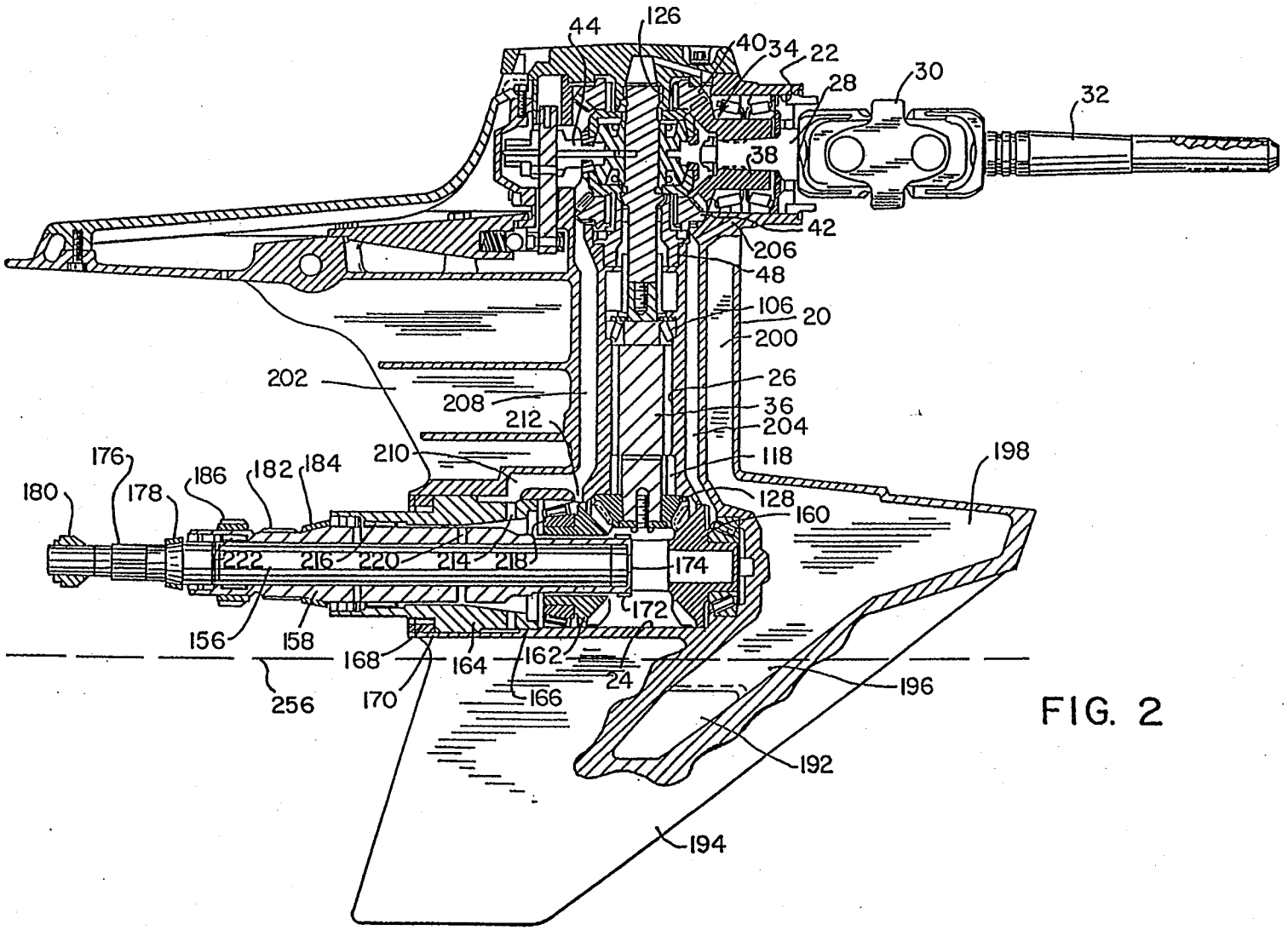
FIG. 2 is a partial sectional view of a portion of the structure of FIG. 1.

A pair of lower concentric counter-rotating inner and outer propeller shafts 156 and 158, FIG. 2, in lower horizontal bore 24 are driven by driveshaft 36. Inner propeller shaft 156 has a fore gear 160 driven by pinion gear 128 to drivingly rotate inner propeller shaft 156. Outer propeller shaft 158 has an aft gear 162 driven by pinion gear 128 to drivingly rotate outer propeller shaft 158 in the opposite rotational direction than inner propeller shaft 156. Reference is made to allowed incorporated U.S. application Ser. No. 07/889,530, filed May 27, 1992. The dual propeller shaft assembly is mounted in horizontal bore 24 by a spool assembly 164 at right hand threads 166 and retaining ring 168 having left hand threads 170. The right hand threads prevent right hand rotational loosening of the spool assembly, and the left hand threads 170 prevent left hand rotational loosening of the spool assembly. Forward thrust is transferred from the outer propeller shaft 158 to the inner propeller shaft 156 at thrust bearing 172 against annular shoulder 174 on inner propeller shaft 156. Propeller 12 is mounted on inner propeller shaft 156 in splined relation at 176 between tapered ring 178 and threaded nut 180. Propeller 14 is mounted on outer propeller shaft 158 in splined relation at 182 between tapered ring 184 and threaded nut 186.

The vertical distance between adaptor spool 48 and lower bearing 118 is about equal to the radius of propellers 12 and 14. Lower horizontal bore 24 of housing 20 is in the portion commonly called the torpedo 188, FIGS. 1 and 4. Torpedo 188 is slightly above the bottom 190 of boat 18 and hence is slightly above the surface of the water, thus reducing drag. This raising of the torpedo above the surface of the water is accomplished without a like raising of the engine in the boat nor the usual transom mounting location for the drive. In the preferred embodiment, the engine is raised 2 to 3 inches above its standard location. Housing 20 is a one-piece unitary integrally cast housing replacing prior two piece housings. Propeller shafts 156, 158 are spaced from upper input shaft 28 by a distance along driveshaft 36 in the range of about 8 to 15 inches.

Cooling water for the engine is supplied through water intake 192 in skeg 194, and flows through skeg passage 196 and then through torpedo nose passage 198 and then through housing passage 200 to the engine in the usual manner. After cooling the engine, the water and engine exhaust are exhausted in the usual manner through an exhaust elbow and exhausted through the housing and discharged at exhaust outlet 202 above torpedo 188 and into the path of the propellers in the upper portion of their rotation, as in U.S. Pat. No. 4,871,334. Oil is circulated from the lower gears upwardly through passage 204 and passage 206 to the upper gears, and returned to the lower gears at passage 208 feeding passages 210 and 212. Oil is supplied from passage 210 through spool assembly passage 214 to bearings 216 and 218, and through outer propeller shaft passage 220 to bearing 222. Passage 212 supplies oil to the front of bearing 218. Central outer section 64 of adaptor spool 48 closes off oil passage 204, to divert flow to passage 206.

Figure 5:
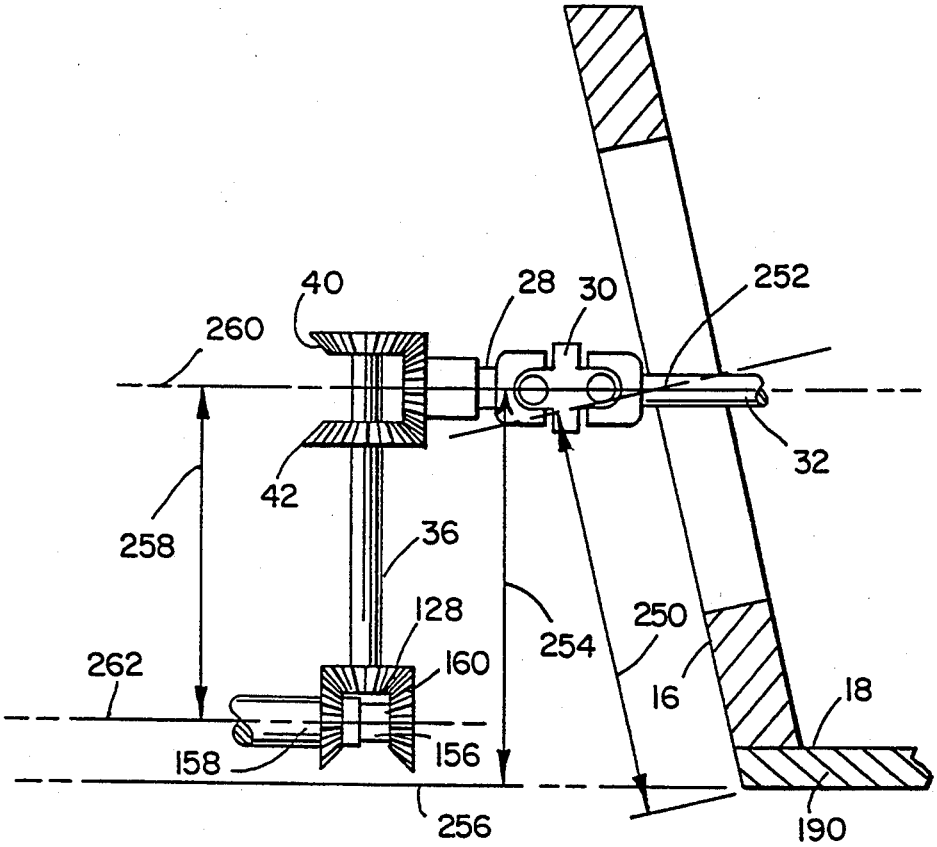
FIG. 5 is a schematic view illustrating the transom X-dimension, vertical X-dimension, and shaft-spacing dimension.

Drive 10 has a transom X-dimension 250, FIG. 5, defined as the distance along the transom 16 of boat 18 between the axis of rotation 252 of engine-driven shaft 32 at transom 16 and the bottom 190 of the boat at transom 16. The drive has a vertical X-dimension 254 defined as the vertical distance between the axis of rotation of engine-driven shaft 32 at transom 16 and the plane 256 of the bottom 190 of boat 18. The drive has a shaft-spacing dimension 258 defined as the vertical distance between the horizontal center-line of upper horizontal bore 22 which is the axis of rotation 260 of upper input shaft 28 and the horizontal center-line of lower horizontal bore 24 which is the axis of rotation 262 of concentric counter-rotating propeller shafts 156 and 158. The drive has a surfacing dimension 264, FIG. 1, defined as the vertical distance between the bottom of torpedo 188 and plane 256 when propeller shafts 156 and 158 are parallel to plane 256.

The drive has a vertical X-dimension 254 in the range of about 13 inches to 19 inches in combination with a shaft-spacing dimension 258 in the range of about 8 inches to 15 inches in combination with a surfacing dimension $\geqq$ zero. In one embodiment, the surfacing dimension was 2 inches, and about 3 inches of propeller diameter was below plane 256. It is preferred that the shaft-spacing dimension be in the range of about 11 inches to 14 inches and that the vertical X-dimension be in the range of about 15 inches to 17 inches. In a particular preferred embodiment, the shaft-spacing dimension was 13.5 inches and the vertical X-dimension was 16 inches. The structure of the invention enables a dual propeller surfacing drive, yet does not require that the drive be mounted high on the transom, and instead maintains a desirable X-dimension.

In a preferred embodiment, torpedo or gear box 188 is raised such that it is entirely above the water surface during high speed operation. The bottom of torpedo 188 is at or above plane 256. Respective propellers 12 and 14 are mounted by respective propeller hubs 266 and 268 to respective propeller shafts 156 and 158. The bottom of each propeller hub 226 and 268 is at or above plane 256, and each propeller hub is entirely above the water surface.

Housing 20 has the noted skeg 194 extending downwardly below torpedo 188. During normal running operation with the boat on plane, the water line is above water intake 192. Each propeller has a plurality of blades extending radially from the respective hub and defining a propeller diameter across the circumference defined by the outer tips of the blades during rotation. In the preferred embodiment, one-third to one-fifth propeller diameter is below plane 256. In one implementation, the dimension of propeller diameter below plane 256 is about 3 inches, and the rotational axis centerline of propeller shafts 156 and 158 is about 5 inches above plane 256.

As above noted, drive 10 is trimmable in and out. When the drive is trimmed in, the aft end of torpedo 188 moves downwardly. When the drive is trimmed out, the aft end of torpedo 188 moves upwardly. The drive has a given trimmed-in condition, e.g. when torpedo 188 extends at an upward angle from the aft end thereof relative to horizontal, and the bottom of propeller hubs 266 and 268 define a horizontal line at or above plane 256. This reduces drag, including in the trimmed-in condition, by keeping both hubs and the torpedo above the water line.

It is recognized that various equivalents, alternatives and modifications are possible within the scope of the append claims.

We claim:

1. A marine drive for propelling a boat comprising:

a housing having upper and lower spaced generally horizontal bores and an intersecting generally vertical bore extending therebetween, said housing comprising a lower generally horizontal torpedo portion around said lower horizontal bore;

an upper input shaft in said upper horizontal bore coupled through a universal joint to an engine-driven shaft;

a downwardly extending driveshaft in said vertical bore and driven by said upper input shaft;

an upper gear in said housing and operatively connected between said input shaft and said driveshaft;

a pair of lower concentric counter-rotating propeller shafts in said lower horizontal bore and driven by said driveshaft;

a lower gear in said housing and operatively connected between said driveshaft and said propeller shafts;

a pair of counter-rotating surface operating propellers each mounted to a respective one of said propeller shafts;

a lower bearing at the bottom Of said vertical bore and supporting said driveshaft for rotation;

an adaptor spool at the intersection of the top of said vertical bore and the bottom of said upper horizontal bore and supporting said driveshaft for rotation, wherein the vertical distance between said adaptor spool and said lower bearing is about equal to propeller radius;

said drive having a transom X-dimension defined as the distance along the transom of the boat between the axis of rotation of said engine-driven shaft at the transom and the bottom of the boat, said drive having a vertical X-dimension defined as the vertical distance between the axis of rotation of said engine-driven shaft at the transom and the boat bottom surface extended aft, said drive having a shaft-spacing dimension defined as the distance between the axis of rotation of said upper input shaft and the axis of rotation of said concentric counter-rotating propeller shafts, said drive having a surfacing dimension defined as the vertical distance between the bottom of said torpedo and said aft extension of the boat bottom surface when said propeller shafts are parallel to said aft extension of the boat bottom surface, wherein said drive has a vertical X-dimension in the range of 13 inches to 19 inches in combination with a shaft-spacing dimension in the range of 8 inches to 15 inches.

2. The invention according to claim 1 wherein said drive has a surfacing dimension ≧ zero.

3. A marine drive for propelling a boat comprising:

a housing having upper and lower spaced generally horizontal bores and an intersecting generally vertical bore extending therebetween, said housing comprising a lower generally horizontal torpedo portion around said lower horizontal bore;

an upper input shaft in said upper horizontal bore coupled through a universal joint to an engine-driven shaft;

a downwardly extending driveshaft in said vertical bore and driven by said input shaft;

an upper gear in said housing and operatively connected between said input shaft and said driveshaft:

a pair of lower concentric counter-rotating propeller shafts in said lower horizontal bore and driven by said driveshaft;

a lower gear in said housing and operatively connected between said driveshaft and said propeller shafts;

a pair of counter-rotating surface operating propellers each mounted to a respective one of said propeller shafts;

a lower bearing at the bottom of said vertical bore and supporting said driveshaft for rotation:

an adaptor spool at the intersection of the top of said vertical bore and the bottom of said upper horizontal bore and supporting said driveshaft for rotation, wherein the vertical distance between said adaptor spool and said lower bearing is about equal to propeller radius;

said drive having a transom X-dimension defined as the distance along the transom of the boat between the axis of rotation of said engine-driven shaft at the transom and the bottom of the boat, said drive having a vertical X-dimension defined as the vertical distance between the axis of rotation of said engine-driven shaft at the transom and the boat bottom surface extended aft, said drive having a shaft-spacing dimension defined as the distance between the axis of rotation of said upper input shaft and the axis of rotation of said concentric counter-rotating propeller shafts; said drive having a surfacing dimension defined as the vertical distance between the bottom of said torpedo and said aft extension of the boat bottom surface when said propeller shafts are parallel to said aft extension of the boat bottom surface, wherein said drive has a vertical X-dimension in the range of 13 to 19 inches in combination with a surfacing dimension ≧ zero.

4. The invention according to claim 3 wherein said drive has a shaft-spacing dimension in the range of 8 inches to 15 inches.

5. The invention according to claim 3 wherein said surfacing dimension is at least 2 inches.

6. A marine drive for propelling a boat comprising:

a housing having upper and lower spaced generally horizontal bores and an intersecting generally vertical bore extending therebetween, said housing comprising a lower generally horizontal torpedo portion around said lower horizontal bore;

an upper input shaft in said upper horizontal bore coupled through a universal joint to an engine-driven shaft;

a downwardly extending driveshaft in said vertical bore and driven by said input shaft;

an upper gear in said housing and operatively connected between said input shaft and said driveshaft;

a pair of lower concentric counter-rotating propeller shafts in said lower horizonal bore and driven by said driveshaft;

a lower gear in said housing and operatively connected between said driveshaft and said propeller shafts;

a pair of counter-rotating surface operating propellers each mounted to a respective one of said propeller shafts;

a lower bearing at the bottom of said vertical bore and supporting said driveshaft for rotation;

an adaptor spool at the intersection of the top of said vertical bore and the bottom of said upper horizontal bore and supporting said driveshaft for rotation, wherein the vertical distance between said adaptor spool and said lower bearing is about equal to propeller radius;

said drive having a transom X-dimension defined as the distance along the transom of the boat between the axis of rotation of said engine-driven shaft at the transom and the bottom of the boat, said drive having a vertical X-dimension defined as the vertical distance between the axis of rotation of said engine-driven shaft at the transom and the boat bottom surface extended aft, said drive having a shaft-spacing dimension defined as the distance between the axis of rotation of said upper input shaft and the axis of rotation of said concentric counter-rotating propeller shafts, said drive having a surfacing dimension defined as the vertical distance between the bottom of said torpedo and said aft extension of the boat bottom surface when said propeller shafts are parallel to said aft extension of the boat bottom surface, wherein said drive has a shaft-spacing dimension in the range of 11 inches to 14 inches.

7. The invention according to claim 6 wherein said vertical X-dimension is in the range of 15 inches to 17 inches.

8. The invention according to claim 6 wherein said shaft-spacing dimension is 13.5 inches, and said vertical X-dimension is 16 inches.

9. The invention according to claim 6 wherein said surfacing dimension is ≧ zero.

10. The invention according to claim 6 wherein said surfacing dimension is at least 2 inches.

11. A marine drive for propelling a boat comprising:

a housing having upper and lower spaced generally horizontal bores and an intersecting generally vertical bore extending therebetween, said housing comprising a lower generally horizontal torpedo portion around said lower horizontal bore;

an upper input shaft in said upper horizontal bore coupled through a universal joint to an engine-driven shaft;

a downwardly extending driveshaft in said vertical bore and driven by said upper input shaft;

an upper gear in said housing and operatively connected between said input shaft and said driveshaft;

a pair of lower concentric counter-rotating propeller shafts in said lower horizontal bore and driven by said driveshaft;

a lower gear in said housing and operatively connected between said driveshaft and said propeller shafts;

a pair of counter-rotating surface operating propellers each mounted to a respective one of said propeller shafts; a lower bearing at the bottom of said vertical bore and supporting said driveshaft for rotation;

an adaptor spool at the intersection of the top of said vertical bore and the bottom of said upper horizontal bore and supporting said driveshaft for rotation, wherein the vertical distance between said adaptor spool and said lower bearing is about equal to propeller radius;

said drive having a vertical X-dimension defined as the vertical distance between the axis of rotation of said engine-driven shaft at the transom and a horizontal plane passing through the lowermost points of the boat bottom, said drive having a shaft-spacing dimension defined as the distance between the axis of rotation of said upper input shaft and the axis of rotation of said concentric counter-rotating propeller shafts, wherein said drive has a vertical X-dimension in the range of 13 inches to 19 inches in combination with a shaft-spacing dimension in the range of 8 inches to 15 inches.

* * * * *